US008080501B2

(12) United States Patent
Habeeb et al.

(10) Patent No.: US 8,080,501 B2
(45) **Date of Patent: *Dec. 20, 2011**

(54) GREEN LUBRICANT COMPOSITIONS

(75) Inventors: Jacob J. Habeeb, Westfield, NJ (US); Douglas E. Deckman, Mullica Hill, NJ (US); Brandon T. Weldon, Pearland, TX (US); Steven P. Rucker, Warren, NJ (US); Michael E. Landis, Mullica Hill, NJ (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 59 days.

This patent is subject to a terminal disclaimer.

(21) Appl. No.: 12/322,791

(22) Filed: Feb. 6, 2009

(65) Prior Publication Data

US 2009/0221460 A1 Sep. 3, 2009

Related U.S. Application Data

(60) Provisional application No. 61/067,582, filed on Feb. 29, 2008.

(51) Int. Cl.
*C10M 137/10* (2006.01)
*C10M 129/74* (2006.01)

(52) U.S. Cl. ..... 508/369; 508/382; 508/465; 508/485

(58) Field of Classification Search ..... 508/369, 508/459, 462, 463, 467, 382, 465, 485
See application file for complete search history.

(56) References Cited

U.S. PATENT DOCUMENTS

| | | | | |
|---|---|---|---|---|
| 3,755,250 | A * | 8/1973 | Wollensak et al. | 524/137 |
| 4,568,663 | A | 2/1986 | Mauldin | |
| 4,705,641 | A | 11/1987 | Goldblatt et al. | |
| 4,827,064 | A | 5/1989 | Wu | |
| 4,827,073 | A | 5/1989 | Wu | |
| 4,956,122 | A | 9/1990 | Watts et al. | |
| 5,049,290 | A * | 9/1991 | Emert et al. | 508/270 |
| 5,348,982 | A | 9/1994 | Herbolzheimer et al. | |
| 5,545,674 | A | 8/1996 | Behrmann et al. | |
| 5,739,089 | A | 4/1998 | Colclough | |
| 2004/0110104 | A1 | 6/2004 | Guinther et al. | |

FOREIGN PATENT DOCUMENTS

| | | |
|---|---|---|
| EP | 0 317 354 B1 | 5/1989 |
| WO | WO 2008/011338 A2 | 1/2008 |
| WO | WO 2008/039345 A2 | 4/2008 |

OTHER PUBLICATIONS

Vipper, A. B., et al., "The interaction between zinc dithiophosphates [(ZDTP)] and oil soluble metal salts [with respect to their antiwear properties in lubricants] Wechselwirkung zwischen Zinkdithiophosphaten und oelloeslichen Metallsalzen", *Tribologie & Schmierungstechnik*, V41, N.3, 135-137 (May-Jun. 1994) (Abstract Only).

(Continued)

*Primary Examiner* — Glenn Caldarola
*Assistant Examiner* — Taiwo Oladapo
(74) *Attorney, Agent, or Firm* — Robert A. Migliorini

(57) ABSTRACT

The present invention is directed to green lubricant compositions comprising a base oil and an effective amount of premixed additives that improve wear protection and reduce phosphorus emissions.

3 Claims, 1 Drawing Sheet

OTHER PUBLICATIONS

Figure 1:
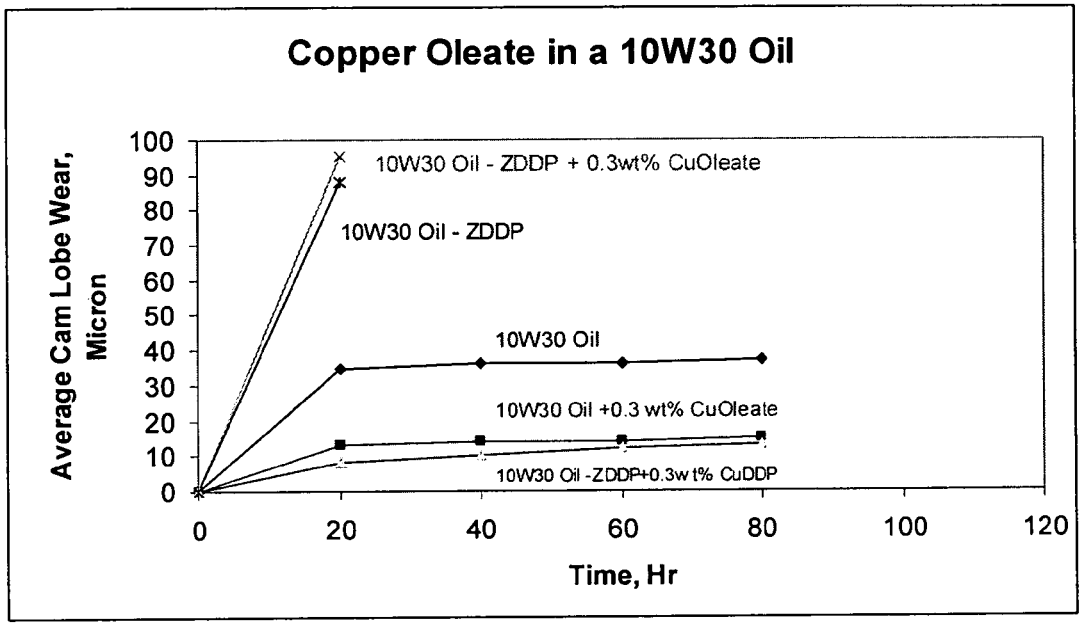

Wallfahrer, U., "Polymer esters and their synergy with ZDDP [Zinc dithiodialkylphosphate)] . . . A possibility to reduce ZDDP content in lubricants?", Technische Akademie Esslingen 9$^{th}$ International "Ecological & Economic Aspects of Triboloby" Colloquiun (Esslingen Jan. 11-13, 1994) Proceedings, V2 11.14-1-11.14-10 (1994) (Abstract Only).

Bonadies, J. A., et al., "Structurally Diverse Manganese(III) Schiff Base Complexes : Chains, Dimers, and Cages", *Inorganic Chemistry*, 1989, 28, 2037-2044.

Larson, E. J., "The Peroxide-Dependent $\mu_2$-O Bond Formation of $[Mn^{IV}SALPN(O)]_2$", *Journal of the American Chemical Society*, 1991, 113, 3810-3818.

Wu, A. J., "Structural, Spectroscopic, and Reactivity Models for the Manganese Catalases", *Chemical Review*, 2004, 104, 903-938.

Habeeb, J. J., "The Role of Hydroperoxides in Engine Wear and the Effect of Zinc Dialkyldithiophophates", ASLE Transactions (1987), 30 (4), 419-426.

* cited by examiner

GREEN LUBRICANT COMPOSITIONS

This application claims priority of Provisional Application 61/067,582 filed Feb. 29, 2008.

FIELD OF THE INVENTION

The present invention relates to lubricant compositions having improved wear protection and reduced phosphorus emissions.

BACKGROUND OF THE INVENTION

Zinc dialkyldithiophosphate (ZDDP) has been used as an additive in formulated lubricants for many decades. The primary function of ZDDP is to provide antiwear protection to moving engine parts by interacting with iron oxides to form a protective layer.

The current understanding of the formation of antiwear films from ZDDP involves tribochemical and thermooxidative components. As ZDDP decomposes, metathiophosphates and colloidal polyphosphates are formed. The decomposition of these materials leads to the formation of low molecular weight volatile phosphorus compounds. This occurs because ZDDP is not ash-free and contains phosphorus. These decomposition compounds may have several detrimental effects on engine performance such as reduced wear protection and poisoning of the catalytic converter and/or the exhaust gas oxygen sensor.

Despite the advances in lubricant oil formulation technology, there remains a need for lubricant oil additives that provide superior wear protection and environmentally beneficial properties such as reduced exhaust emissions.

The present invention provides a synergistic combination of a premixed composition comprising a ZDDP and at least one additive that results in the formation of transient intermediates that provide superior wear protection and reduced additive volatility.

SUMMARY OF THE INVENTION

The present invention is directed to lubricant compositions exhibiting improved wear protection and reduced phosphorus emissions.

In one embodiment, there is provided a lubricant composition having improved wear protection and reduced phosphorus emissions. The lubricant composition comprises a major amount of base oil and effective amounts of premixed additives comprising ZDDP and one or more oil soluble organometallic compounds selected from the group consisting of:

(a) one or more metal(s) or metal cations having more than one oxidation state above the ground state, excluding iron and nickel, complexed, bonded or associated with two or more anions;

(b) one or more metal(s) or metal cations having more than one oxidation state above the ground state, excluding iron and nickel, complexed, bonded or associated with one or more bidentate or tridentate ligands;

(c) one or more metal(s) or metal cations having more than one oxidation state above the ground state, excluding iron and nickel, complexed, bonded or associated with one or more anions and one or more ligands; and (d) mixtures thereof provided the anion and/or ligand does not itself render the metal cation inactive, i.e., rendering the metal cation unable to change from one oxidation state above the ground state to another oxidation state above the ground state, decompose or cause polymerization of the metal salt thereby rendering the metal cation inactive as a peroxide decomposer and further provided that (a) when the metals or metal cations are molybdenum, the ligand is not thiocarbamate, thiophosphate, dithiocarbamate or dithiophosphate and (b) when the metals or metal cations are copper the ligand is not acetyl acetate.

As used herein, "oil soluble organometallic compounds" means organometallic compounds and/or organometallic coordination complexes containing one or more of the same or different metal atoms. Preferably, the oil soluble organometallic compounds and/or organometallic coordination complexes contain between two and four metal atoms. The reactivity of any given metal complex will depend on the ionic strength of the ligands and the coordination geometry around the metal center. These factors will affect the ease with which the metal center can effect the oxidation state change necessary for catalytic decomposition of the hydroperoxide or peroxide species. By "premixed" it is meant that at least two additives are mixed and heated before being added to a base oil.

In another embodiment, the lubricant composition comprises a comprises a major amount of base oil and effective amounts of premixed additives comprising ZDDP, an ester and one or more oil soluble organometallic compounds selected from the group consisting of:

(a) one or more metal(s) or metal cations having more than one oxidation state above the ground state, excluding iron and nickel, complexed, bonded or associated with two or more anions;

(b) one or more metal(s) or metal cations having more than one oxidation state above the ground state, excluding iron and nickel, complexed, bonded or associated with one or more bidentate or tridentate ligands;

(c) one or more metal(s) or metal cations having more than one oxidation state above the ground state, excluding iron and nickel, complexed, bonded or associated with one or more anions and one or more ligands; and (d) mixtures thereof provided the anion and/or ligand does not itself render the metal cation inactive, i.e., rendering the metal cation unable to change from one oxidation state above the ground state to another oxidation state above the ground state, decompose or cause polymerization of the metal salt thereby rendering the metal cation inactive as a peroxide decomposer and further provided that (a) when the metals or metal cations are molybdenum, the ligand is not thiocarbamate, thiophosphate, dithiocarbamate or dithiophosphate and (b) when the metals or metal cations are copper the ligand is not acetyl acetate.

In still another embodiment, there is provided a method of making a lubricant composition having improved antiwear properties and reduced phosphorus emissions comprising forming a premixed composition comprised of a ZDDP and an ester or an oil soluble organometallic compound or a combination thereof; and, adding the premixed composition to a base oil.

In yet another embodiment, there is provided a method for improving wear protection and reducing phosphorus emissions in a lubricant composition comprising adding to a lubricating base oil premixed additives comprising effective amounts of ZDDP and an ester or an oil soluble organometallic compound or a combination thereof.

All proportions given in this specification are based on the total mass of the final lubricant composition, including the mass of any additional constituents not specifically discussed.

Other aspects and advantages of the present invention will become apparent from the detailed description that follows.

DETAILED DESCRIPTION OF THE INVENTION

It has now been found that lubricating compositions comprising a major amount of a base oil and effective amounts of premixed additives comprising ZDDP and an ester or an oil soluble organometallic compound or a combination thereof provide improved wear protection and reduced phosphorus emissions.

Base Oil

Basestocks may be made using a variety of different processes including but not limited to distillation, solvent refining, hydrogen processing, oligomerisation, esterification, and rerefining. API 1509 "Engine Oil Licensing and Certification System" Fourteenth Edition, December 1996 states that all basestocks are divided into five general categories: Group I contain less than 90% saturates and/or greater than 0.03% sulfur and have a viscosity index greater than or equal to 80 and less than 120; Group II contain greater than or equal to 90% saturates and less than or equal to 0.03% sulfur and have a viscosity index greater than or equal to 80 and less than 120; Group III contain greater than or equal to 90% saturates and less than or equal to 0.03% sulfur and have a viscosity index greater than or equal to 120; Group IV are polyalphaolefins (PAO); and Group V include all other basestocks not included in Group I, II, III or IV. The test methods used in defining the above groups are ASTM D2007 for saturates; ASTM D2270 for viscosity index; and one of ASTM D2622, 4294, 4927 and 3120 for sulfur. Group IV basestocks, i.e. polyalphaolefins (PAO) include hydrogenated oligomers of an alpha-olefin, the most important methods of oligomerisation being free radical processes, Ziegler catalysis, and cationic, Friedel-Crafts catalysis.

Formulated lubricant compositions comprise a mixture of a base stock or a base oil and at least one performance additive. Usually, the base stock is a single oil secured from a single crude source and subjected to a single processing scheme and meeting a particular specification. Base oils comprise at least one base stock. The base oil constitutes the major component of the lubricating oil composition and typically is present in an amount ranging from about 50 wt. % to about 99 wt. %, e.g., from about 85 wt. % to about 95 wt. %, based on the total weight of the composition.

The lubricating base oils of the present invention may be selected from the group consisting of natural oils, petroleum-derived mineral oils, synthetic oils and mixtures thereof boiling in the lubricating oil boiling range.

The base oils of the present invention typically include those oils having a kinematic viscosity at 100° C. in the range of 2 to 100 cSt, preferably 4 to 50 cSt, more preferably about 8 to 25 cSt.

Natural oils include animal oils, vegetable oils (castor oil and lard oil, for example), and mineral oils. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention.

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example).

Polyalphaolefins (PAOs) base stocks are commonly used as synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are herein incorporated by reference.

Unconventional base stocks include one or more of a mixture of base stock(s) derived from one or more Gas-to-Liquids (GTL) materials. GTL base oil comprise base stock(s) obtained from a GTL process via one or more synthesis, combination, transformation, rearrangement, and/or degradation deconstructive process from gaseous carbon containing compounds. Preferably, the GTL base stocks are derived from the Fischer-Trospch (FT) synthesis process wherein a synthesis gas comprising a mixture of $H_2$ and CO is catalytically converted to lower boiling materials by hydroisomerisation and/or dewaxing. The process is described, for example, in U.S. Pat. Nos. 5,348,982 and 5,545,674, and suitable catalysts in U.S. Pat. No. 4,568,663, each of which is incorporated herein by reference.

GTL base stock(s) are characterized typically as having kinematic viscosities at 100° C. of from about 2 cSt to about 50 cSt. The GTL base stock(s) and/or other hydrodewaxed, or hydroisomerized/cat (or solvent) dewaxed wax derived base stock(s) used typically in the present invention have kinematic viscosities in the range of about 3.5 cSt to 7 cSt, preferably about 4 cSt to about 7 cSt, more preferably about 4.5 cSt to 6.5 cSt at 100° C. The GTL base stock(s) are also characterized typically as having viscosity indices of 80 or greater, preferably 100 or greater, and more preferably 120 or greater.

There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content Low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

Antiwear Agent

Metal dithiophosphates represent a class of additives which are known to exhibit antioxidant and antiwear properties. The most commonly used additives in this class are the zinc dialkyldithiophosphates (ZDDP) which provide excellent oxidation resistance and exhibit superior antiwear properties. ZDDPs are the preferred phosphorus compounds in the present invention. Treat levels for ZDDP in engine oils are generally expressed as the amount of phosphorus delivered to the oil and are typically 1000 ppm phosphorus (0.1 wt. % phosphorus). Preferably, ZDDP is present as phosphorus in the range from about 100 to 10000 ppm by weight, more preferably from about 200 to 5,000 ppm by weight, most preferably from about 400 to 1,000 ppm by weight. The ZDDP may be primary or secondary or mixed primary/secondary compounds. ZDDP may also be a neutral ZDDP or an overbased ZDDP.

Organometallic Catalytic Hydroperoxide Decomposers/Antioxidant

Oil soluble organometallic compounds comprising metals and anions and/or ligands have been found to be catalytic antioxidant hydroperoxide decomposers in the presence of other peroxide decomposer compounds. In particular, oil soluble organometallic compounds have been found to have a synergistic effect when used in the presence of other peroxide decomposer compounds. The metals of the oil soluble organometallic compounds have more than one oxidation state above the ground state. The anions and/or ligands of the oil soluble organometallic compounds do not render the metal cations inactive. That is, the anions and/or ligands do not render the metal cations unable to change from one oxidation state above the ground state to another oxidation stated above the ground state. Additionally, the anions and/or ligands of the oil soluble organometallic compounds do not cause polymerization of the metal salts. Nor are the anions and/or ligands susceptible to decomposition thereby rendering the metals inactive.

The following formula generally represents the oil soluble organometallic compounds of the present invention $$[M^n(\text{Ligand})]_y$$

where M is the metal or metal cation;

n is the oxidation state;

y is the number of metal cations in the complex and is ≧1; and ligand is the organic anionic and/or ligand moiety complexing the metal.

The metal component having more than one oxidation state above the ground state of the oil soluble organometallic compound catalytic hydroperoxide decomposer is selected from the group consisting of transition metal elements 21 through 30, excluding nickel, elements 39 through 48, elements 72 through 80, metals of the lanthanide series, metals of the actinide series and mixtures thereof. Preferably, the metal component is selected from the group consisting of transition metal elements 21 through 30, excluding nickel, elements 39 through 48, elements 72 though 80 and mixtures thereof. More preferably, the metal component is selected from the group consisting of transition metal elements 21 through 30, excluding nickel, elements 39 though 48, elements 72 through 80 and mixtures thereof. Still more preferably the metal component is selected from the group consisting of transition metal elements 21 though 30 excluding nickel, elements 39 through 48 excluding molybdenum, elements 72 through 80 and mixtures thereof. Even more preferably, the metal component is selected from the group consisting of manganese, cobalt, iron, copper, chromium and zinc.

The oil soluble organometallic compound can be utilized in effective amounts, typically in the range of about 1 to 1000 ppm by weight based on the total amount of lubricant composition, preferably about 25 to 500 ppm, more preferably about 50 to 200 ppm.

In the oil soluble organometallic compounds useful in the present invention, the organic anionic and/or ligand moiety complexing the metals can be either neutral (e.g., bipyridyl) or anionic (e.g., acac). To avoid either self-polymerization or polymerization with/through other species in the oil, the ligands, generally, should avoid high levels of polar functionality, high-polarity atoms in the functional groups, reactive structures such as olefins, and unstable geometries whose strain energy could be relieved through polymerization.

Such organic moiety include materials derived from salicylic acid, salicylic aldehyde, carboxylic acids which may be aromatic acids, naphthenic acids, aliphatic acids, cyclic, branched aliphatic acids and mixtures thereof. Among the useful ligands are acetylacetonate, naphthenates, phenates, stearates, carboxylates, etc. Preferred ligands are polydentate Schiff base ligands which are the reaction products of salicylic aldehyde and diamines. Preferred polydentate Schiff base ligands include N,N'-disalicylidene-1,3-diaminopropane (H2Salpn) and N,N'-disalicylidene-1,4-diaminobutane (H2Salbn) ligands, H2Salpn ligands being the most preferred. Nitrogen-, oxygen-, sulfur-, and phosphorus-containing ligands, preferably oxygen-, nitrogen-, or oxygen and nitrogen-containing ligands (e.g., bipyridines, thiophenes, thiones, carbamates, phosphates, thiocarbamates, thiophosphates, dithiocarbamates, dithiophosphates, etc.), also give rise to useful oil soluble organometallic compounds provided the metal orbital remain free to exhibit its ability to change from one oxidation state above the ground state to another oxidation state above the ground state. It is necessary that the oil soluble organometallic compound not be polymerized, but remain as individual molecules. Polymerization causes the metal orbitals to be satisfied in their quest for electrons and become stabilized, thus losing the ability to shift from one oxidation state above the ground state to another oxidation state above the ground state, which has been found necessary for an oil soluble organometallic compound to function effectively. In the case where the metals are molybdenum, the ligand is not thiocarbamate, thiophosphate, dithiocarbamate or dithiophosphate or where the metals are copper the ligand is not acetyl acetonate.

The oil soluble organometallic compounds of the present invention are oil soluble and may be prepared according to J. A. Bonadies, M. L. Kirk, M. S. Lah, D. P. Kessissoglou, W. E. Hatfield, and V. L. Pecoraro, *Structure Diverse Manganese (III) Schiff Base Complexes: Chains, Dimers and Cages,* 28, Inorganic Chemistry, 2037-2044 (1989), E. J. Larson and V. L. Pecoraro, *The Peroxide-Dependent $\mu_2$-O Bond Formation of $[Mn^{IV}SALPN(O)]_2$*, 113, J. Am. Chem. Soc., 3810-3818 (1991) and V. L. Pecoraro, J. E. Penner-Hahn and A. J. Wu, *Structural, Spectroscopic, and Reactivity Models for the Manganese Catalases,* 104, Chem. Rev., 903-908 (2004), which are herein incorporated by reference. Preferred oil soluble organometallic compounds include $[MnIII(2\text{-}OHsalpn)]_2$, $[MnIII(2\text{-}OHsalpn)]_2$ II, $[MnIII(5\text{-}Cl\text{-}2\text{-}OH\text{-}salpn)]_2$, $[MnIII(5\text{-}NO2\text{-}2\text{-}OH\text{-}salpn)]_2$, $[MnIV(salpn)(\mu\text{-}O)]_2$, $[MnIV(5\text{-}Cl\text{-}salpn)(\mu\text{-}O)]_2$, $[MnIV(5\text{-}OCH3\text{-}salpn)(\mu\text{-}O)]_2$, $[MnIV(5\text{-}NO2\text{-}salpn)(\mu\text{-}O)]_2$, $[MnIV(3,5\text{-}di\text{-}Cl\text{-}salpn)(\mu\text{-}O)]_2$, $MnII(OAc)_{2[}12\text{-}MCMnIIIshi\text{-}4]$, $\{Li(LiCl2[12\text{-}MCMnIIIshi\text{-}4])\}$ and $MnII(OAc)_{2[}15\text{-}MCMnIIIshi\text{-}5]$, most preferred is $[MnIV(salpn)(\mu\text{-}O)]_2$ Other examples of oil soluble organometallic compounds include, but are not limited to, copper oleate, zinc oleate and metal acetylacetonate.

Esters

Useful esters of the present invention include the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic add, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols e.g. neopentyl glycol, trimethylol ethane, 2-methyl-2-propyl-1, 3propanediol, trimethylol propane, pentaerythritol and dipentaerythritol with alkanoic adds containing at least 4 carbon atoms such as the, normally the $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid.

The most suitable synthetic ester oils are the esters of trimethylol propane, trimethylol butane, trimethylol ethane, pentaerythritol and/or dipentaerythritol with one or more monocarboxylic acids containing from about 5 to about 10 carbon atoms are widely available commercially, for example, the Mobil P-41 and P-51 esters (Mobil Chemical Company).

In general, the ester used will have a viscosity at 100° C. in the range of about 2 to about 4 cSt and preferably about 2.5 to about 3.5 cSt. Preferably, the ester is a tetramethyl propionate polyol ester. The esters of the present invention may be present in amounts ranging from about 1 wt % to about 95 wt %, more preferably in amounts ranging from about 5 wt % to about 75 wt %, most preferably in amounts ranging from about 10 wt % to about 50 wt %, based on the total weight of the lubricant composition.

Typical Additive Amounts

The lubricant composition of the present invention may also comprise at least one additional additive. The additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in Table 1 below, as well as other amounts mentioned in this patent, are directed to the amount of active ingredient (that is the non-solvent portion of the ingredient). The wt % indicated below are based on the total weight of the lubricant composition.

TABLE 1

Typical Amounts of Various Lubricant Oil Components

| Compound | Approximate Wt % (Useful) | Approximate Wt % (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |
| Supplementary Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

The present invention provides for heating a mixture of at least two additives before adding the mixture of additives to a base oil. Preferably, the premixed additives are heated to a temperature ranging from about 30° C. to about 80° C.

The following non-limiting examples are provided to illustrate the invention.

EXAMPLES 1-9

In examples 1 through 9, a series of oils were formulated using a low SAP 5W-30 oil having a kinematic viscosity of 11 cSt at 100° C. and containing typical additive components as are shown in Table 1. A fully formulated oil, a partially formulated oil to 75 wt. % of the same package and a partially formulated oil to 50 wt. % of the same package were used. The fully formulated oil contained ZDDP in the amount of 0.08 wt. % P. The concentration of ZDDP is expressed as the amount of phosphorus, P, delivered to the oil, wt. % P. The reduced package formulations were used to determine the effect and performance of the addition of a dimanganese organometallic compound, $[MnIV(salpn)(\mu\text{-}O)]_2$. Three concentrations of the dimanganese organometallic compound were added: 100 ppm, 200 ppm and 500 ppm by weight.

The average wear scar was measured using a High Frequency Reciprocating Rig (HFRR), commercially available from PCS Instruments. The HFRR test method measures the lubricity, or ability of a fluid to affect friction between surfaces in relative motion under a load. The test method used was based on a modification of ASTM D6079. ASTM D6079 is incorporated herein by reference. The modified test method used is as follows. A 2-mL test specimen of oil was placed in the test reservoir of an HFRR. The temperature of the specimen was increased from 30° C. to 160° C. at a rate of 2° C./minute. When the specimen temperature was stabilized at 160° C., a vibrator arm holding a non-rotating steel ball and loaded with 400-g mass was lowered until it contacted a test disk completely submerged in the specimen. The ball was caused to rub against the disk with a 1-mm stroke at a frequency of 60 Hz for 75 minutes.

As is demonstrated in Table 2, the average wear scar increased as the wt % of the package was decreased and the dimanganese organometallic compound was absent. This was due to the decrease in the concentration of ZDDP (by 25 wt % in Example #2 and 50 wt % in Example #3). The addition of a dimanganese organometallic compound to the partially formulated oil (75 wt. %) exhibited very good wear protection as is seen in Example 4. Similarly, addition of 100 ppm of the dimanganese organometallic compound to the partially formulated (50 wt %) oil, Example 7, also showed excellent wear protection in the HFRR test.

TABLE 2

| Example | Wt. % Package | ZDDP, ppm | Dimanganese Organometallic Compound, ppm | HFRR Avg. Wear Scar Microns, μ |
|---|---|---|---|---|
| 1 | 100 | 800 | 0 | 183 |
| 2 | 75 | 600 | 0 | 204 |
| 3 | 50 | 400 | 0 | 298 |
| 4 | 75 | 600 | 100 | 181 |
| 5 | 75 | 600 | 200 | 186 |
| 6 | 75 | 600 | 500 | 180 |
| 7 | 50 | 400 | 100 | 208 |
| 8 | 50 | 400 | 200 | 207 |
| 9 | 50 | 400 | 500 | 212 |

EXAMPLE 10

In this example, a motored 2.3 L engine wear test was used to evaluate the effect of copper oleate on ZDDP and wear. The fired tests were carried out on a Sequence V-D test stand which also used the same model 2.3 L engine. A new premeasured camshaft and new followers were used for each test. As in the Sequence V-D test, wear is defined as the reduction in the heel-to-toe dimension at the point of maximum lift on the cam lobe. Cam lobe measurements were made at intervals during each test using a calibrated micrometer and after allowing the engine to cool to room temperature. A more detailed description of the procedure can be found in J. J. Habeeb, et al., "The Role of Hydroperoxides in Engine Wear and the Effect of Zinc Dialkyldithiophosphates," ASLE Transactions (1987), 30 (4), page 419-26, which is incorporated herein by reference.

Copper oleate in an amount of 0.3 wt % was added to 10W30 fully formulated oil containing secondary ZDDP (isopropyl/4-methyl-2-pentyl) in an amount of 1.0 wt. %. The addition of copper oleate significantly reduced the average cam lobe wear in the motored 2.3 L engine in the first 20 hours from 35 to 13 microns as shown below in FIG. 1. Copper oleate is not a known antiwear agent. However, when used in combination with ZDDP, copper oleate reacts synergistically to provide increased wear protection. This additional wear protection is due to the ability of ZDDP and copper oleate to form a complex that contains CuDDP. This ZDDP/Cu oleate complex is expected to have higher molecular weight than ZDDP, be more thermally stable than ZDDP alone and be only tribochemically active at the metal-metal contact (boundary areas). By tribochemically active it is meant that a set of chemical reactions will occur between surfaces and the chemical species inside the sliding contact where the load is mostly supported by the boundary lubrication conditions.

As is demonstrated in FIG. 1, copper oleate does not provide antiwear protection in the absence of ZDDP. However, when combined with ZDDP, copper oleate unexpectedly increases antiwear protection in the oil.

EXAMPLES 11-14

Examples 11 through 14 are set forth in Table 3 where the amount of phosphorus loss is measured using inductively coupled plasma emission spectrometry. A ZDDP, an ester and a dimanganese organometallic compound were premixed, stirred and heated to about 40° C. The premixed additives were then added to a Group III base stock that had been heated to 40° C. and stirred. For comparative purposes, lubricant compositions were prepared according to what is known in the art, that is, a Group III base stock was heated to about 70° C. and stirred. To the basestock was added a ZDDP, an ester and a dimanganese organometallic compound. Each additive was blended into the basestock before adding the subsequent additive. The mixtures of ZDDP, ester, dimanganese organometallic compound and Group III base stock were then heated to 170° C. for thirty minutes in a round bottom flask fitted with a coldwater condenser. The ZDDP used was a secondary ZDDP (isopropyl/4-methyl-2-pentyl), commercially available from the Lubrizol Corporation. All samples contained ZDDP in the amount of about 0.1 wt. % P. The concentration of ZDDP is expressed as the amount of phosphorus, P, delivered to the oil, wt. % P. The ester used was a tetramethyl propionate polyolester. The dimanganese organometallic compound was $[MnIV(salpn)(\mu\text{-}O)]_2$. Phosphorus loss was measured using inductively coupled plasma emission spectrometry. The error of reproducibility is ±0.0001.

TABLE 3

| Sample | Mixture | Wt % P at 40° C. (after 30 minutes) | Wt % P after heating to 170° C. (after 30 minutes) | Wt % P Loss (No Pre-mixing) | Wt % P Loss (Pre-mixing) |
|---|---|---|---|---|---|
| 11 | Lz 1371<br>Mn complex<br>5 wt % ester<br>Group III Basestock | 0.1170 | 0.0840 | 28.2 | — |
| 12 | Lz 1371<br>Mn complex<br>5 wt % ester<br>Group III Basestock | 0.1170 | 0.0940 | — | 20.51 |
| 13 | Lz 1371<br>Mn complex<br>Group III Basestock | 0.1090 | 0.0840 | 22.9 | — |
| 14 | Lz 1371<br>Mn complex<br>Group III Basestock | 0.1090 | 0.0950 | — | 12.8 |

It was unexpectedly found that by premixing the additives and then adding the premixed additives to the basestock, the loss of phosphorus to the atmosphere was greatly reduced. Phosphorus retention increased by more than 25% when a combination of a ZDDP, an ester and an oil soluble organometallic compound were premixed and added to a basestock. Even more unexpected was the significant improvement in phosphorus retention, by more than 40%, when ZDDP was premixed with an oil soluble organometallic compound alone and then added to a basestock. By improving the amount of phosphorus retained in the oil, the antiwear properties of the lubricant composition are maintained and most importantly, phosphorus emissions into the environment are reduced.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

It is also understood that the following claims are intended to cover all of the generic and specific features of the invention herein described and all statements of the scope of the invention, which as a matter of language, might be said to fall therebetween.

What is claimed is:

1. A lubricant composition having improved wear protection and reduced phosphorous emissions comprising a major amount of a base oil and an effective amount of premixed additives comprising a ZDDP, a tetramethyl propionate polyolester and an oil soluble dimanganese organometallic compound.

2. A method of making a lubricant composition having improved antiwear properties and reduced phosphorous emissions wherein said lubricant composition comprises a major amount of a base oil and an effective amount of a ZDDP, a tetramethyl propionate polyolester and an oil soluble dimanganese organometallic compound the method comprising forming a premixed composition comprising the ZDDP, the polyol ester and said oil soluble organometallic compound; and adding the premixed composition to said base oil.

3. A method for improving wear protection and reducing phosphorous emissions in a lubricant composition comprising adding to a lubricating base oil effective amounts of premixed additives comprising ZDDP and, a tetramethyl propionate polyolester having a viscosity at 100° in the range of about 2 to about 4 cSt and an oil soluble dimanganese organometallic compound.

* * * * *